United States Patent [19]

McMakin

[11] 4,156,577

[45] May 29, 1979

[54] ONSHORE/OFFSHORE METHOD AND APPARATUS FOR DRILLING

[76] Inventor: Robert G. McMakin, 1634 S. Gessner, Houston, Tex. 77063

[21] Appl. No.: 787,836

[22] Filed: Apr. 15, 1977

[51] Int. Cl.[2] ..... B63B 35/00

[52] U.S. Cl. ..... 405/196; 405/209; 114/56; 114/265; 9/8 P

[58] Field of Search ..... 114/264–266, 114/56, 61; 9/8 P; 61/86, 87, 88, 89, 90, 91, 93, 101, 104; 405/1, 3, 265, 196

[56] References Cited

U.S. PATENT DOCUMENTS

| | | | |
|---|---|---|---|
| 3,078,680 | 2/1963 | Wepsala | 114/61 |
| 3,946,864 | 3/1976 | Sumner | 114/265 |
| 3,951,097 | 4/1976 | Clark | 114/265 |
| 3,996,755 | 12/1976 | Kalinowski | 114/265 |

*Primary Examiner*—Trygve M. Blix
*Assistant Examiner*—D. W. Keen
*Attorney, Agent, or Firm*—Guy E. Matthews

[57] ABSTRACT

A self-propelled drilling tender has mounted therewith a drilling rig and a jack-up platform adapted to be mounted on the drilling tender or ship for transportation from one drilling site to another site. Thereafter drilling operations occur with the drilling on the ship thus enabling the ship to operate as a drilling ship or the platform legs can be lowered to jack the platform off the ship to thereby enable the platform to operate independently as a drilling platform. Further, if desired, the rig can be disassembled or lifted from the drilling platform and moved to land operations adjacent or in the vicinity of the drilling platform and ship to thereby enable land drilling operations to occur.

5 Claims, 13 Drawing Figures

ONSHORE/OFFSHORE METHOD AND APPARATUS FOR DRILLING

BRIEF SUMMARY OF THE INVENTION

Briefly, the present invention relates to a new and improved onshore/offshore method and apparatus for drilling operations wherein a combination tender, drilling platform and drilling rig are suitably and modularly constructed to enable drilling operations to occur in connection with the tender or with the drilling platform or with tender and platform as a drilling ship or with the drilling rig separated from the tender and drilling platform for land operations.

In the prior art, it is known to tow suitable floating drilling platforms having jack-up capabilities to locations with tugs and the like to thereafter jack the legs down to the floor of the ocean surface and jack the platform up for drilling operations. Occasionally, such platforms tip over while they are being towed, causing great economic loss in addition to loss of life.

It is also known to utilize a drilling rig in combination with a ship to form a drilling ship, but such operations have problems and limitations because of the desire to drill exactly in the selected location. These problems and limitations are created by certain sea conditions, such as wave action and the like, thereby causing stability and anchoring problems.

Further, it is known to float or carry platforms on top of barges or tenders for drilling operations at the selected locations.

DESCRIPTION OF THE PREFERRED EMBODIMENT

Figure 1:
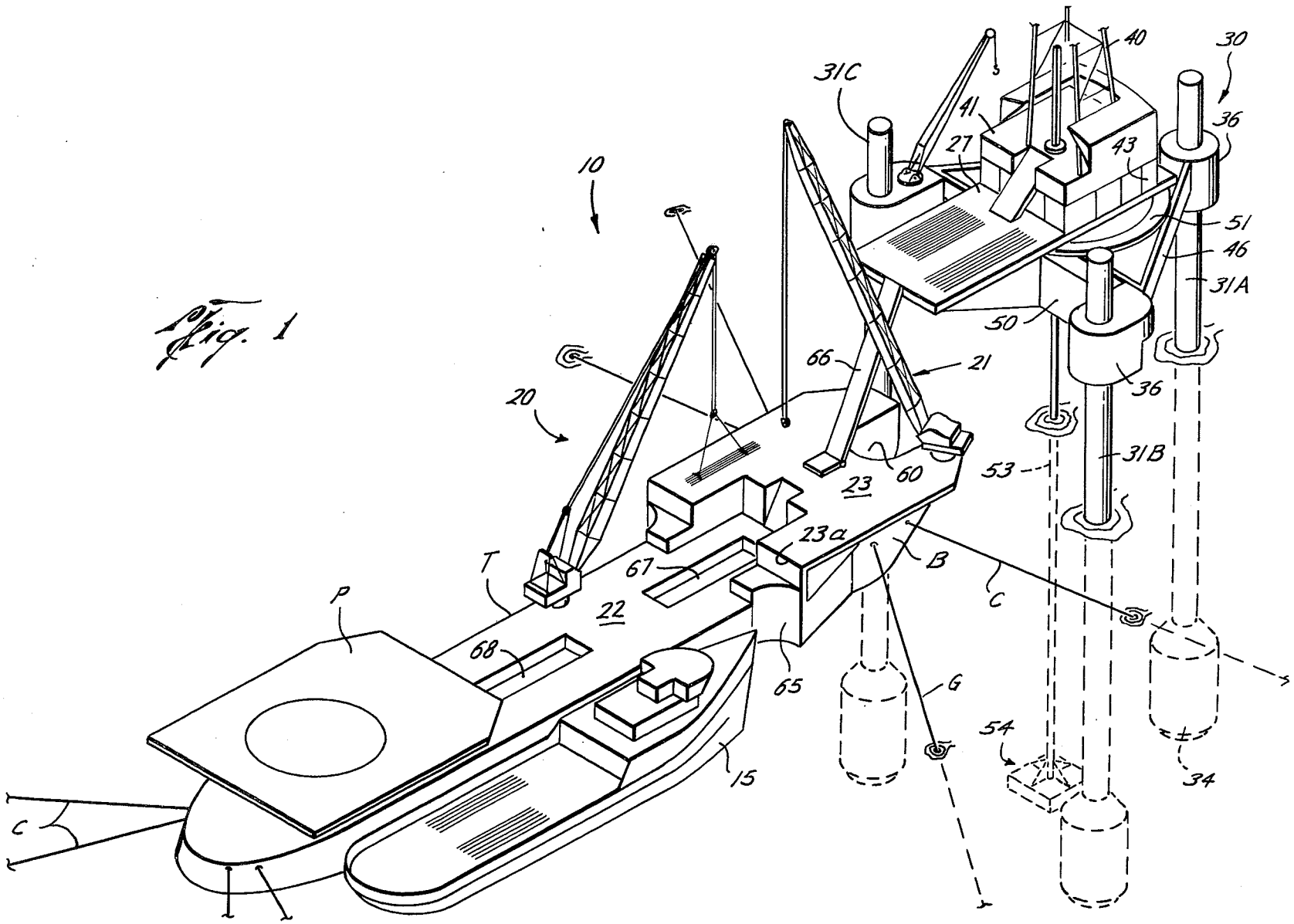
FIG. 1 is a perspective view of a drilling tender and a platform operating as a first drilling ship.

As illustrated in FIG. 1, the drill ship of the present invention is generally illustrated at numeral 10 and includes a ship or tender T mounted with suitable anchor cables C. Personnel, supplies and the like are moved into and out of the drilling operation area by providing either a landing pad P on tender T or using a support tug 15, or both.

Ship T includes suitable lifting apparatus 20 and 21 for enabling pipe and the like to be lifted from midships deck 22 and bow deck 23 of tender T to a pipe rack 27 on a drilling platform generally illustrated at 30. In the embodiment shown in FIGS. 1–4, drilling platform 30 includes three jacking legs 31A, 31B and 31C with a jack-up member 36 inter-connecting each leg to platform 30. A pod 34 is attached to each leg 31A, 31B and 31C for positioning against the earth's surface, such as an ocean floor or a sea or river bed (not numbered). Drilling legs 31A, 31B and 31C extend upwardly from the surface of the earth for suitable engagement with jacking members 36 to provide stability during drilling operations while permitting movement of platform 30 along legs 31A, 31B and 31C.

A suitable drilling rig 40 is mounted on platform 30 and includes a drilling rig floor 41, related drilling equipment and elevating sub-base structure 43 mounted upon platform 30. Preferably, rig 40 is a derrick type drilling rig capable of removal from platform 30 for use at other drilling sites, either onshore or offshore. It is preferred that rig 40 be mounted on tender T with the apex of the derrick directed toward the stern R of tender T.

Figure 4:
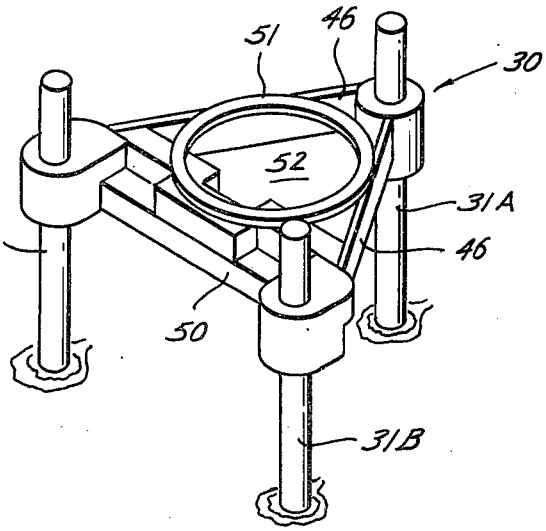
FIG. 4 is a perspective view illustrating a platform structure utilizing three jack-up legs without the drilling rig.

In the embodiment of platform 30 shown in FIG. 4, cross-support members 46 are mounted between legs 31A and 31B and between legs 31A and 31C with cross-support member 50 mounted between legs 31B and 31C. A ring support member 51 is mounted on cross-support members 46 and 50 and receivably supports pipe rack 27, drilling rig 40, and sub-base structure 43, thereby forming a plane. Preferably, cross-support member 50 and jacking members 36 mounting legs 31B and 31C to platform 30 are constructed to permit movement of the legs in a direction substantially parallel to the plane. An opening 52 passing through ring support member 51 enables drill string 53 to extend therethrough for drilling operations on the ocean floor and into the earth's surface, as illustrated generally at 54 in FIG. 1.

Figure 2:
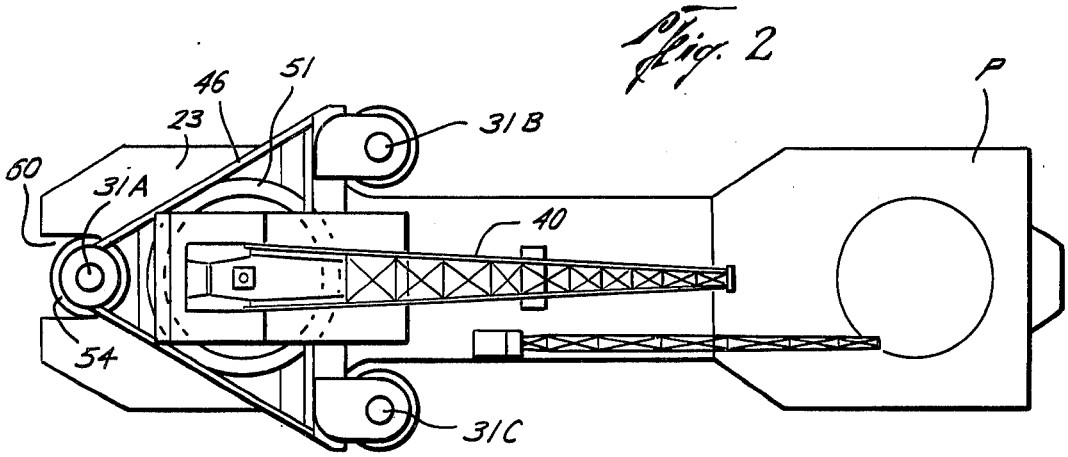
FIG. 2 is a top view of a platform with three jack-up legs mounted on a drilling tender.
Figure 3:
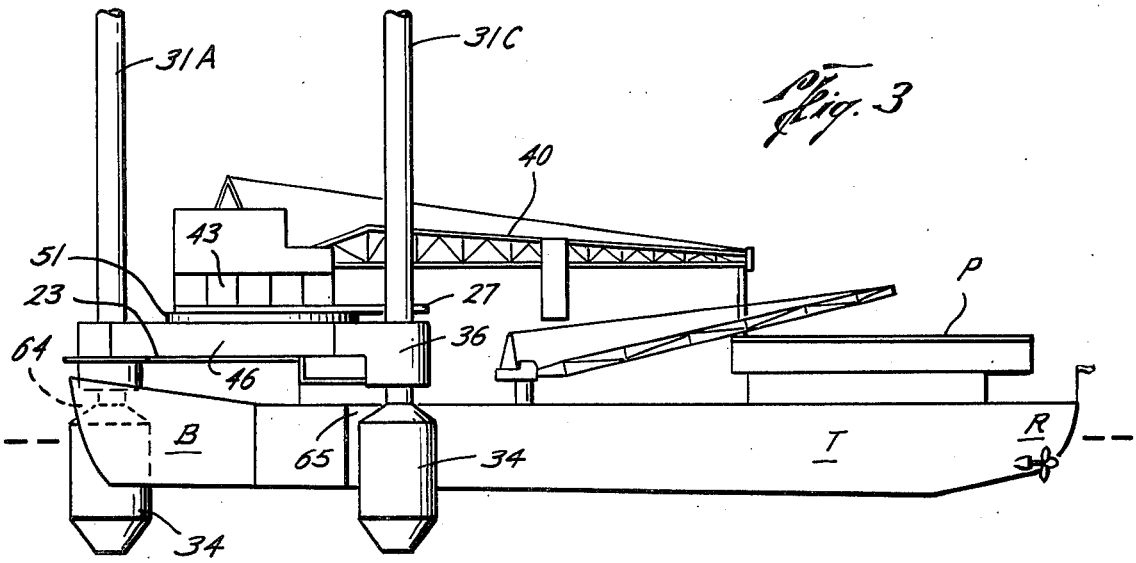
FIG. 3 is a side view of the modification shown in FIG. 2.

As illustrated in FIGS. 1–3, platform 30 and tender T are releasably mounted, tender T being capable of movement to and from different locations. In this embodiment of the invention, bow B is constructed so that bow deck 23 receives and supports cross members 46 and 50, thus enabling platform 30 and drilling rig 40 to be carried to the desired locations. This construction is accomplished by cutting a slot 60 into bow B and bow deck 23 to enable leg 31A and pod 34 to extend therethrough. Since legs 31B and 31C and their respective pods 34 are movable along support member 50 for positioning adjacent the rear 23A of bow deck 23, a curved exterior recess 65 is provided in bow B to partially circumferentially fit pods 34 for nesting with ship T. Tender T may also have openings 67 and 68 in midships deck 22 for passage of drilling equipment and other materials from the hold to the decks for use. With drilling platform 30 mounted on bow B, and legs 31A, 31B and 31C extending upwardly as illustrated in FIGS. 2 and 3, tender T is capable of passage through relatively narrow canals and passages, such as the Panama Canal. Therefore, the movement of tender T to and from desired locations is not halted or delayed. When tender T has reached the desired drilling site, jacking member 36 carrying legs 31B and 31C are slid outwardly to the outboard position, legs 31A, 31B and 31C are jacked downwardly until pods 34 reach the ocean floor and thereafter platform 30 moves upwardly relative to tender T. Platform 30 is raised sufficiently to permit tender T to pull away from platform 30 and to enable drilling rig 40 to function as is well known in the art.

When desired, tender T is pulled away from platform 30 just sufficiently to permit the attachment of tender T to platform 30 by a suitable walkway or ramp 66 extending upwardly from bow deck 23 to pipe rack 27. However, when desired, tender T may pull completely away leaving platform 30 and rig 40 to function in a conventional manner with supplies being brought for use by other means such as tug 15.

Another embodiment a drill ship of the present invention is illustrated in FIGS. 5, 6, 7, 7A and 8 and includes a ship or tender T' having a suitable helicopter or landing pad P'. A suitable midships deck 101 is positioned between stern R and bow B of tender T' and is provided with suitable padding members 102 for supporting a drilling platform generally designated by the number 110. Tender T' is also suitably anchored by cable C' to the ocean floor.

Platform 110 generally includes legs 111, 112, 113 and 114 with pods 115, which rest on the earth's surface, such as the ocean floor, when such legs are jacked downwardly by jack-upmembers 116. A suitable pin mount 117 is used to secure each jacking member 116 to platform structure 118, which allows jacking members 116 to rotate and fold legs 111 and 112 together and legs 113 and 114 together to obtain stability during transportation, as shown in FIG. 7A and explained in greater detail hereinafter.

During jacking operations, jack-up members 116 are locked and secured in position by the outwardly extending projections 119 adjacent each of the corners of platform structure 118. Platform structure 118 also has mounted therewith a suitable helicopter pad P'', a pipe rack support structure 120 for supporting pipe and the like, a suitable equipment shed and a drilling floor structure 121 for a drilling rig 122. As is well known in the art, a drilling string extends vertically through floor structure 121, such string 125 being used for drilling operations on the ocean floor generally illustrated at 126.

Figures 5, 7A:
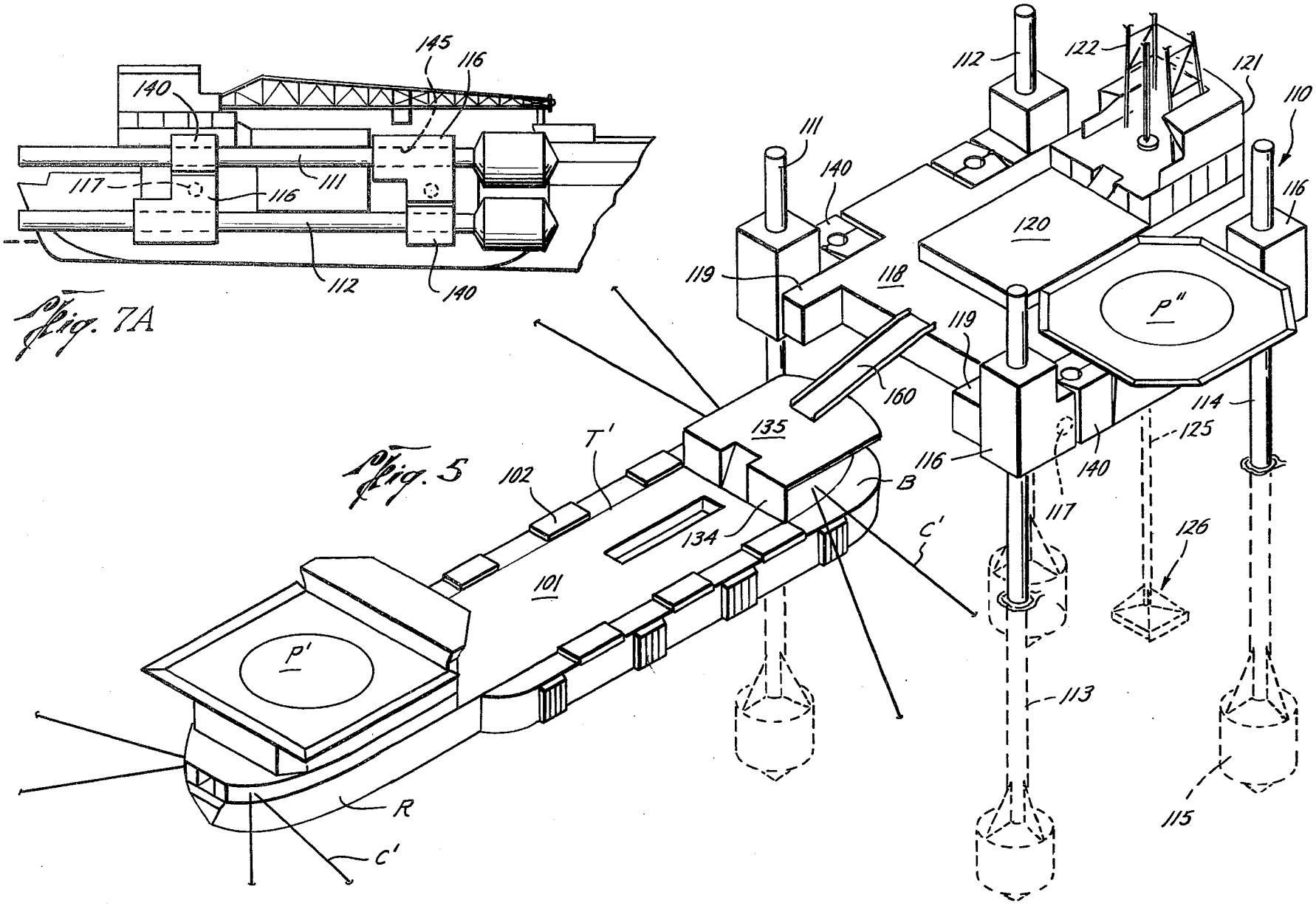
FIG. 5 is a perscpetive view of a drilling tender and a platform operating as a second drilling ship.
FIG. 7A is a side view of a modified platform mounted on a drilling tender.
Figure 6:
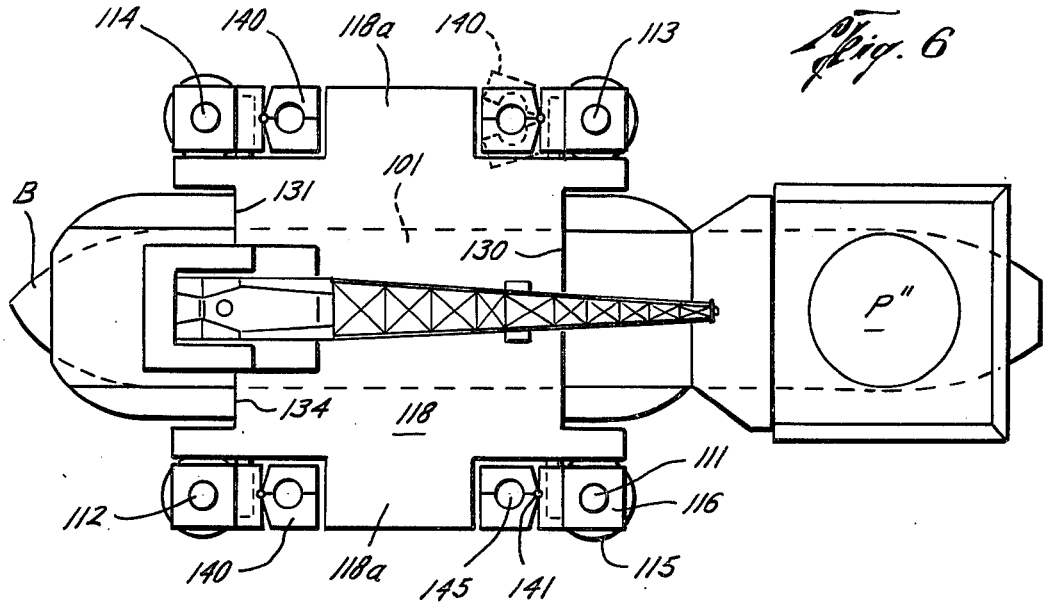
FIGS. 6 and 7 are top and side views, respectively, of a platform with four jack-up legs mounted on a drilling tender.
Figure 7:
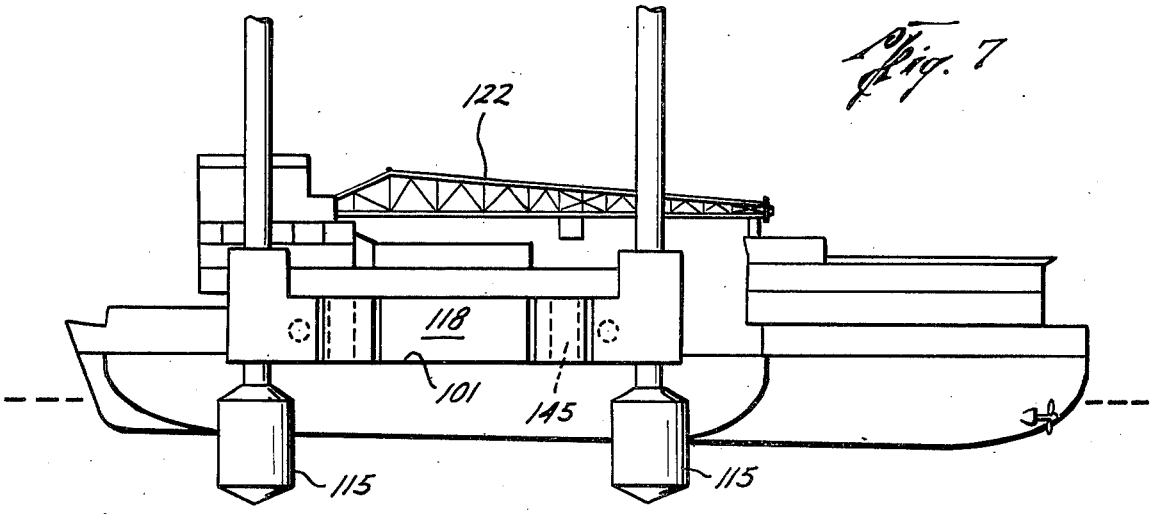
Figure 8:
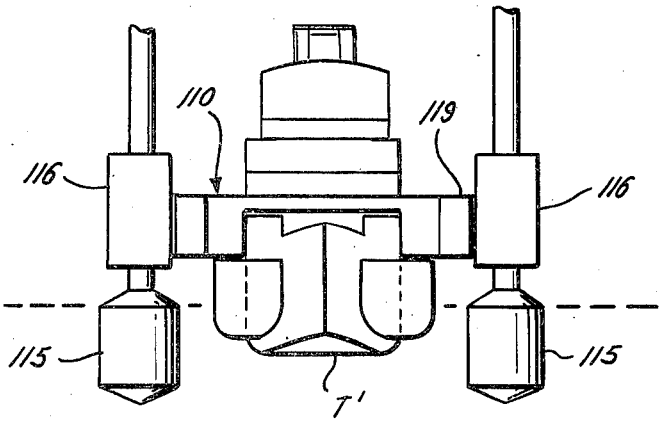
FIG. 8 is a front view of the drill ship of FIGS. 5, 6 and 7.
Figure 10:
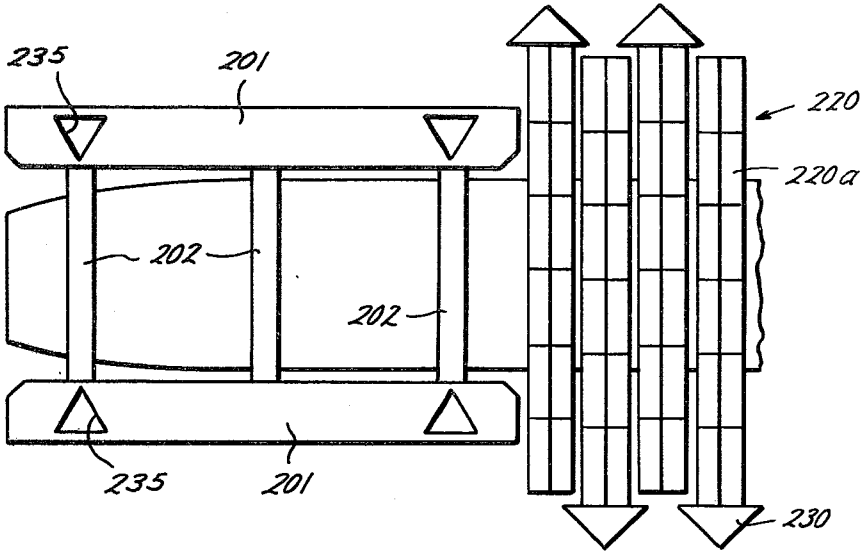
FIG. 10 is a top view taken along line 10—10 of the modification shown in FIG. 9.

As illustrated in FIGS. 6, 7 and 8, platform structure 118 is positioned on top of midships deck 101 such that slot 130 or 131 about an end 134 of bow deck 135 (FIG. 5) for riding across oceans, seas, bays and the like. When traveling, but not wanting to fold legs 111–114, as described below, pods 115 may be drawn up adjacent the bottom of tender T' so that they will not drag on the ocean floor, sea bed, river bed and the like.

FIGS. 6, 7 and 7A illustrate folding legs 111 and 112 together and legs 113 and 114 together for lying parallel to the longitudinal length of tender T' when desired for transporting through turbulent water or over long distances. Each jacking member 116 had mounted immediately adjacent therewith a carrier member 140 with an opening 145 therethrough for receiving the companion drilling leg mounted on the same side of tender T'.

Each carrier member 140 is positioned on the inside of its adjacent jacking member 116 and adjacent the outwardly extending section 118A of the platform 118. Carrying members 140 are mounted by suitable hinged means 141 and are able to expand outwardly utilizing suitable hydraulic operations to receive the appropriate platform legs, as illustrated in dotted outline in FIG. 6. To hold legs 111 and 112 together, legs 111 and 112 and their respective jacking member 116 are rotated about pin members 117. Each carrying member 140 is expanded outwardly around hinged means 141 for receiving respective legs 111 and 112 through opening 145. Thus, leg 111 is received, carried and supported by the jacking member 116 and carrying member 140 mounting leg 112, and leg 112 is received, carried and supported by the jacking member 116 and carrying member 140 mounting leg 111. It is to be understood that similar operations occur on the oposite side of tender T' for jack-up legs 113 and 114. Legs 111 and 112 and 113 and 114, thus lie parallel to the longitudinal length of tender T' for lowering the center of gravity.

It should also be apparent that tender T' and platform 110 are operable in a manner similar to tender T and platform 30 illustrated in FIGS. 1–3. Namely, that when tender T' has reached the selected drilling site, legs 111–114 are jacked downwardly until pods 115 touch the ocean floor, sea bed, river bed and the like. Platform 110 is then raised sufficiently high to permit tender T' to be thereafter backed away from platform 110. A suitable ramp 160 may then be added to enable communication between bow deck 135 and platform main deck 118.

FIGS. 9–12, illustrate other modifications of the present invention wherein the platform and drilling rig mounted therewith can be cantilevered out over the rear of the tender. Also, illustrated is the use of suitable modular stacked legs supported by the tender during transportation and then being attached to the platform for support.

Figure 9:
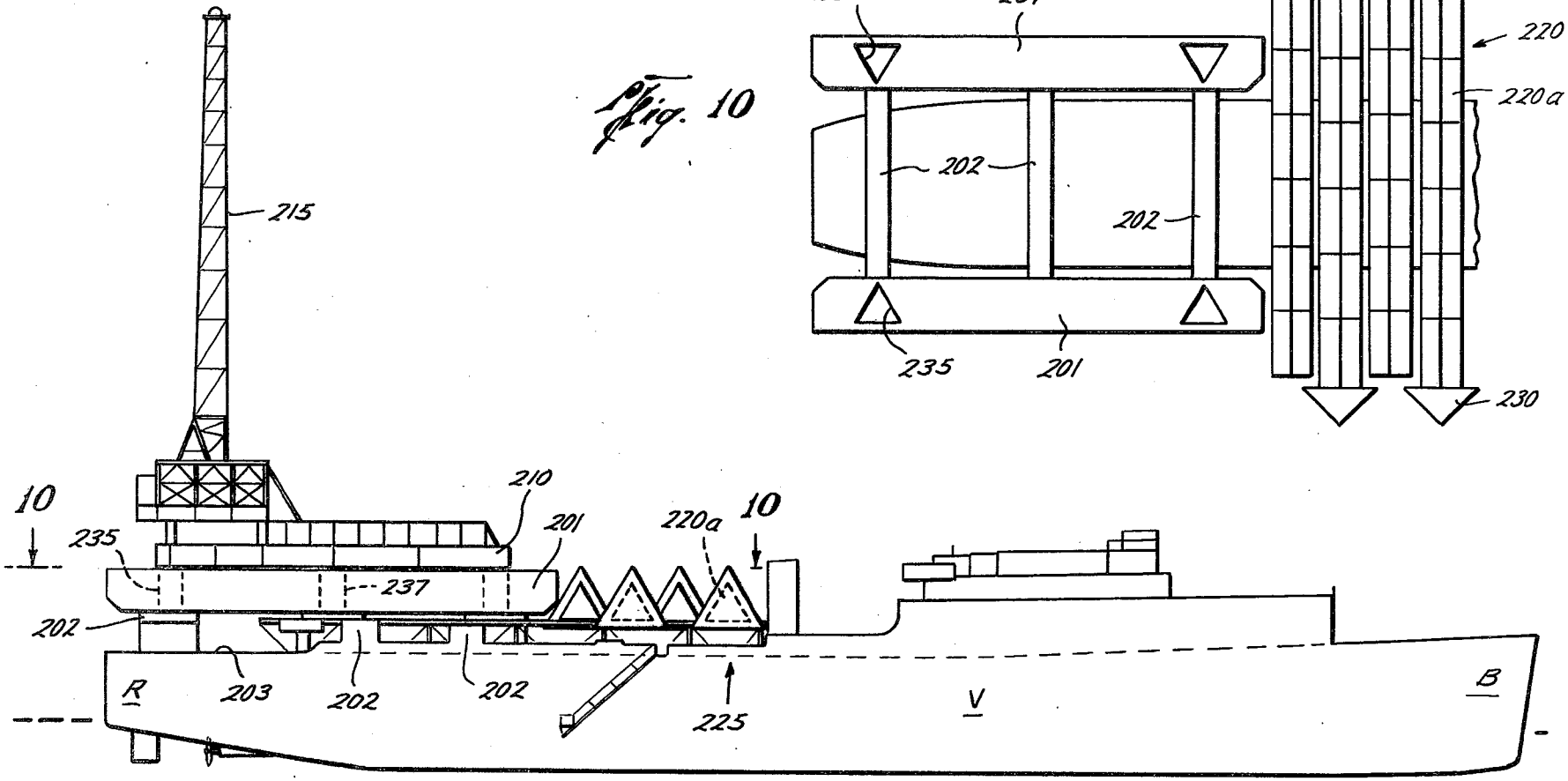
FIG. 9 is a side view of another modification of the present invention.
Figure 11:
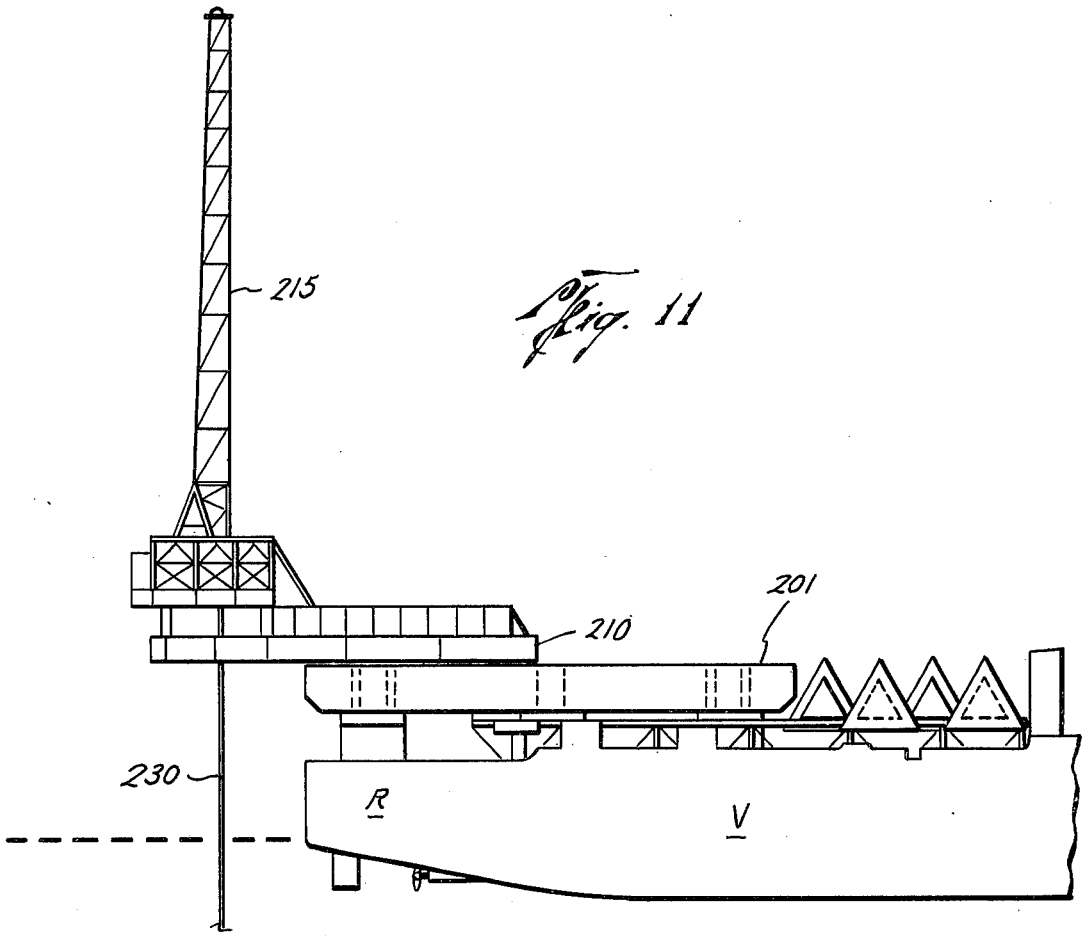
FIG. 11 is a side view of the modification shown in FIG. 9 operating as a drill ship.
Figure 12:
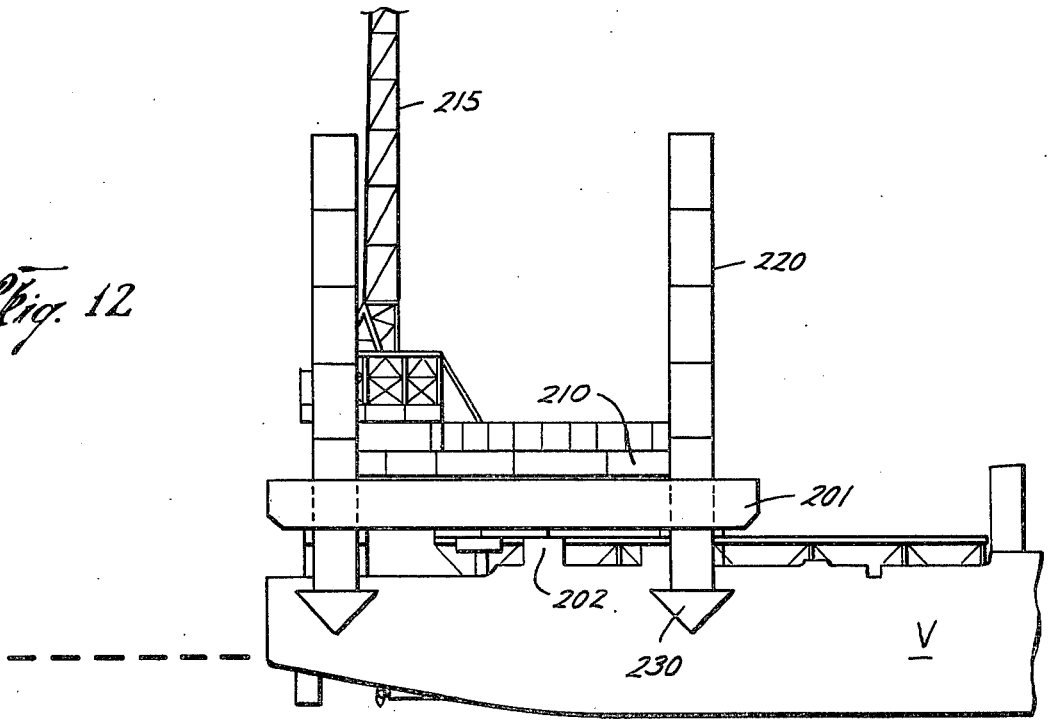
FIG. 12 is a side view of the modification shown in FIG. 9 with jack-up legs positioned within the platform.

As illustrated in FIGS. 9 and 11, a suitable ship or vessel V includes a bow B and stern R. A drilling platform 201 is releasably supported by suitable platform supports 202 mounted on the rear deck 203 of vessel V. A drilling rig base 210 is skid-mounted (not shown) with drilling platform 201 to enable structure 210 to move outwardly over the stern R of the vessel V. A drilling rig 215 operating, such as described in connection with FIGS. 1–8, may be positioned over the ocean floor for drilling operations with a drill string 230. In this embodiment, rig base 210, rig 215 and drilling platform 201 are cantilevered over stern R of vessel V for enabling vessel V to operate as a drill ship.

In some operations, such as long or dangerous travel across oceans and seas, it might not be economical or advantageous to have the platform legs mounted to the platform. Thus, in the embodiment illustrated in FIGS. 9–12, legs 220 are constructed from modular sections 220A, which are releasably connected to each other. During transportation and storage, sections 220A are stacked transversely midships of vessel V in the area generally illustrated at 225. Ocean floor stabilizing pods 230 may also be stored in area 225. Thus, FIGS. 9 and 10 basically illustrate vessel V when traveling with leg sections 220A being positioned and secured across midships 225 and drilling rig 215 being laid across leg sections 220A erect or as otherwise desired.

If it is desired to enable the drilling operations to be performed as platform drilling operations, legs 220 are lifted by suitable operations and inserted through the retainer and jacking members 235 mounted on platform 201. Drilling rig 215 is moved onto a central position over platform 201 striding lateral platform members 202. Thereafter, legs 220 are jacked downwardly until stability pods 230 reach the ocean floor and then platform 201 is jacked upwardly off of support structure 202 so that vessel V may be moved out from under structure 201 for drilling operations to begin. The necessary equipment used for drilling operations is of modular design and is positioned inside and between platform supports 202. This equipment may even include drilling rig 215 and other necessary equipment, such as pumps, generators and engines. It should be understood, that drilling rig 215 can be constructed and used equally well for onshore and offshore drilling operations without using either platform 201 or vessel V.

While the present invention has been disclosed as having several different modifications, it is to be understood that such modifications or alternative embodiments are exemplary only and that these alternative embodiments are not intended to limit the scope of the present invention.

What is claimed is:

1. An independent and portable offshore drilling structure adapted to perform drilling operations comprising:

a jack-up drilling platform including a plurality of self-contained jack-up means comprising jack-up platform support legs for removably engaging the ocean floor, and being the sole support means for supporting said platform above the water surface during drilling operations, at least some of said jacking means being mounted in sliding engagement to said drilling platform side to enable said slidable jacking means, and jack-up legs therewith, to move from an outboard location when supporting said drilling platform above the water surface to a location inboard in order to nest said jacking means to a tender vessel while in transit to enable said platform to pass through narrow waterways; and a jacking mechanism for raising and lowering all of said legs relative to said platform;

a drilling rig mounted on said platform for drilling holes in the ocean floor; and a vessel for supporting said drilling platform and drilling rig, transporting said platform about and for use as a tender during drilling operations.

2. The structure of claim 1, wherein said platform is triangular and includes three jacking member means for connecting one jack-up leg to each triangular platform apex, and wherein a first jacking means is permanently mounted to a platform apex and the remaining two jacking means are mounted in sliding engagement to the drilling platform side opposite said first jacking means to enable said slidable jacking means, and jack-up legs therewith, to move between the outboard and inboard positions, and wherein said vessel includes a slot in one end thereof for receiving said first jacking means and retaining same during transporting of said jack-up platform.

3. An independent and portable offshore drilling structure adapted to perform drilling operations comprising:

a jack-up drilling platform including a plurality of self-contained jack-up means comprising jack-up platform support legs for removably engaging the ocean floor, and being the sole support means for supporting said platform above the water surface during drilling operations, said platform being rectangular and including four jacking member means for connecting one jack-up leg each to said platform, two of said jacking means disposed on each side of the longitudinal length of said platform, each of said jacking means including a carrier member for receiving, grasping, supporting and carrying two of said legs together on each side of said platform and adapted to pivot about a horizontal axis for rotating said legs between a vertical orientation for jacking said legs down to engage the ocean floor and a horizontal orientation wherein each said carrier member grasps said leg carried by said jack-up means located on the same side of said platform and constrains said leg horizontally to insure stability of said platform support legs during transporting of said platform to a drilling site; and a jacking mechanism for raising and lowering all of said legs relative to said platform;

a drilling rig mounted on said platform for drilling holes in the ocean floor; and a vessel for supporting said drilling platform and drilling rig, transporting said platform about and for use as a tender during drilling operations.

4. A method of offshore drilling comprising:

providing a portable jack-up drilling platform having a drilling rig thereon, and having a plurality of jack-up legs for supporting the platform and rig from the ocean floor during drilling operations, each jack-up leg operating with a jacking mechanism for raising and lowering the legs relative to the platform;

stowing the drilling rig and drilling platform on board a ship adapted to receive and transport same;

locating the ship at the selected drilling site;

moving said legs from an inboard to an outboard position while maintaining said legs vertical in order to provide a more stable drilling platform;

jacking down the platform support legs to contact the ocean floor to establish stability of the drilling platform;

jacking up the platform off of the ship;

moving the ship from under the platform;

performing drilling operations with the drilling rig while it is positioned on the platform;

moving the ship in position under the platform following termination of drilling operations;

jacking down the drilling platform back onto the ship;

jacking up the support legs of the drilling platform sufficiently to enable the platform and ship to move about free from possible interference between the platform support legs and the ocean floor;

repositioning said legs from the outboard to the inboard position, while maintaining said legs vertical, in order to effect a narrowing of the drilling platform during transporting thereof; and removing the entire drilling platform and drilling rig, including all means of supporting same on the ocean floor, from the site for relocation at another drilling site.

5. A method of offshore drilling comprising:

providing a portable jack-up drilling platform having a drilling rig thereon, and having a plurality of jack-up legs for supporting the platform and rig from the ocean floor during drilling operations, each jack-up leg operating with a jacking mechanism for raising and lowering the legs relative to the platform;

stowing the drilling rig and drilling platform on board a ship adapted to receive and transport same;

locating the ship at the selected drilling site;

pivoting said legs from a horizontal to a vertical position, in order to be jacked down to contact the ocean floor;

jacking down the platform support legs to conract the ocean floor to establish stability of the drilling platform;

jacking up the platform off of the ship;

moving the ship from under the platform;

performing drilling operations with the drilling rig while it is positioned on the platform;

moving the ship in position uner the platform following termination of drilling operations;

jacking down the drilling platform back onto the ship;

jacking up the support legs of the drilling platform sufficiently to enable the platform and ship to move about free from possible interference between the platform support legs and the ocean floor;

pivoting said legs from the vertical to the horizontal position and grasping said legs within appropriate carrying members to insure stability of said platform support legs during transporting of said platform; and removing the entire drilling platform and drilling rig, including all means of supporting same on the ocean floor, from the site for relocation at another drilling site.

* * * * *